US011710908B2

(12) United States Patent
Cao et al.

(10) Patent No.: US 11,710,908 B2
(45) Date of Patent: Jul. 25, 2023

(54) SHARED-APERTURE DUAL-BAND DUAL-POLARIZED ANTENNA ARRAY AND COMMUNICATION EQUIPMENT

(71) Applicant: SOUTH CHINA UNIVERSITY OF TECHNOLOGY, Guangzhou (CN)

(72) Inventors: Yunfei Cao, Guangzhou (CN); Xiuyin Zhang, Guangzhou (CN); Quan Xue, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 17/557,086

(22) Filed: Dec. 21, 2021

(65) Prior Publication Data

US 2023/0039854 A1 Feb. 9, 2023

(30) Foreign Application Priority Data

Aug. 5, 2021 (CN) ..... 202110898052.5

(51) Int. Cl.
*H01Q 21/06* (2006.01)
*H01Q 9/04* (2006.01)
(Continued)

(52) U.S. Cl.
CPC ..... *H01Q 21/065* (2013.01); *H01Q 1/523* (2013.01); *H01Q 5/392* (2015.01); *H01Q 5/45* (2015.01);
(Continued)

(58) Field of Classification Search
CPC ..... H01Q 15/0013; H01Q 15/002; H01Q 15/0026; H01Q 15/0033; H01Q 15/0046; H01Q 15/0053; H01Q 15/0086
See application file for complete search history.

(56) References Cited

U.S. PATENT DOCUMENTS 7,696,951 B2 * 4/2010 Sanada ..... G02B 1/007 343/909
9,035,843 B1 * 5/2015 Mitu ..... H01Q 3/2623 343/700 MS
(Continued)

FOREIGN PATENT DOCUMENTS

CN 112467393 A * 3/2021 ..... H01Q 15/0013

OTHER PUBLICATIONS

Y. Zhu, Y. Chen, and S. Yang, Decoupling and low-profile design of dual-band dual-polarized base station antennas using frequency-selective surface, IEEE Trans. Antennas Propag., vol. 67, No. 8 (Year: 2019).*
(Continued)

*Primary Examiner* — Ab Salam Alkassim, Jr.
(74) *Attorney, Agent, or Firm* — JMB Davis Ben-David

(57) ABSTRACT

The invention discloses shared-aperture dual-band dual-polarized antenna array and communication equipment. The antenna array comprises a first dielectric substrate, a second dielectric substrate, a third dielectric substrate, a fourth dielectric substrate, and a fifth dielectric substrate. The first dielectric substrate, the second dielectric substrate, and the third dielectric substrate constitute a dielectric substrate group. The dielectric substrate group is provided with a low-frequency antenna element and four high-frequency antenna elements. The low-frequency antenna element is loaded with a filtering structure. The low-frequency antenna element and the high-frequency antenna element are fed by coaxial lines. The fourth dielectric substrate and the fifth dielectric substrate form a dual-function metasurface. When the dual-function metasurface is used as an artificial magnetic conductor reflector, the radiation of the low-frequency antenna element is enhanced in a low profile, and when used as a frequency selective surface, the electromagnetic scattering of the low-frequency antenna element in the high-
(Continued)

frequency band is suppressed. Compared with the existing solutions, the present invention is more compact, and maintains high cross-band isolation and stable radiation patterns in dual bands.

10 Claims, 11 Drawing Sheets

(51) Int. Cl.

| | |
|---|---|
| ***H01Q 15/00*** | (2006.01) |
| ***H01Q 5/392*** | (2015.01) |
| ***H01Q 5/45*** | (2015.01) |
| ***H01Q 1/52*** | (2006.01) |
| ***H01Q 13/16*** | (2006.01) |

(52) U.S. Cl.
CPC ..... *H01Q 9/0414* (2013.01); *H01Q 13/16* (2013.01); *H01Q 15/0013* (2013.01); *H01Q 15/0026* (2013.01); *H01Q 15/0086* (2013.01)

(56) References Cited

U.S. PATENT DOCUMENTS 11,424,548 B2* 8/2022 Achour ..... H01Q 21/005
11,450,953 B2* 9/2022 Pelletti ..... H01Q 3/32
2002/0167457 A1* 11/2002 McKinzie, III .... H01Q 15/0066 343/756
2003/0052757 A1* 3/2003 McKinzie, III ..... H01Q 15/008 335/6
2003/0231142 A1* 12/2003 McKinzie, III ..... H01Q 15/008 343/909
2004/0140945 A1* 7/2004 Werner ..... H01Q 15/0086 343/909
2004/0263420 A1* 12/2004 Werner ..... H01Q 1/38 343/909
2005/0029632 A1* 2/2005 McKinzie, III ..... H01P 1/16 257/665
2010/0007569 A1* 1/2010 Sim ..... H01Q 15/008 235/492
2011/0304413 A1* 12/2011 Yen ..... H01Q 15/0026 333/202
2013/0050043 A1* 2/2013 Gross, III ..... H01Q 15/0013 343/912
2013/0201068 A1* 8/2013 Alexopoulos ..... H01Q 19/10 343/834
2014/0097996 A1* 4/2014 Vitaz ..... H01Q 1/42 343/872
2017/0033468 A1* 2/2017 Wong ..... H01P 1/2005
2017/0170557 A1* 6/2017 Shipton ..... C09K 19/18
2018/0269577 A1* 9/2018 Kosaka ..... H01Q 15/0013
2019/0386364 A1* 12/2019 Liang ..... H01Q 15/0086
2019/0386399 A1* 12/2019 You ..... H01Q 21/28
2020/0388929 A1* 12/2020 Celik ..... H01Q 9/0435
2021/0013617 A1* 1/2021 Chang ..... H01Q 15/002
2021/0036400 A1* 2/2021 Hashimoto ..... B62J 45/41
2021/0057821 A1* 2/2021 Jan ..... H01Q 21/0075
2021/0313706 A1* 10/2021 Hiramatsu ..... H01Q 1/36
2022/0278462 A1* 9/2022 Guo ..... H01Q 9/285

OTHER PUBLICATIONS

Li et al.; A Low-Profile Dual-Polarized Dipole Antenna Using Wideband AMC Reflector; IEEE Transactions on Antennas and Propagation, vol. 66, No. 5, May 2018 (Year: 2018).*

* cited by examiner

SHARED-APERTURE DUAL-BAND DUAL-POLARIZED ANTENNA ARRAY AND COMMUNICATION EQUIPMENT

CROSS REFERENCE TO RELATED APPLICATIONS

Benefit is claimed to Chinese Patent Application No. 202110898052.5, filed Aug. 5, 2021, the contents of which are incorporated by reference herein in their entirety.

TECHNICAL FIELD

The invention relates to shared-aperture dual-band dual-polarized antenna array and communication equipment, and belongs to the research field of multi-band base station antennas in wireless mobile communication.

TECHNICAL BACKGROUND

In order to meet the diverse needs of users, the fifth-generation mobile communication (5G) system needs to coexist with the 2G/3G/4G system. Since the 2G/3G/4G base station antenna array has been installed, the space left for 5G antennas is very limited. The shared-aperture multi-band array may solve this problem. It integrates the 5G antenna element and the 2G/3G/4G antenna element in the same radiation aperture. However, it is facing huge design challenges. The cross-band mutual coupling between different-frequency elements in the shared aperture is serious. The different-frequency scattering caused by the induced current on the element in one frequency band will cause the distortion of the radiation pattern of the element in the other frequency band.

Considering the importance of the shared-aperture multi-band array, many researchers have conducted research on it based on a variety of schemes, including parallel separated arrangement, nested, staggered, radiator multiplexed, and stacked. Literature "L. Zhao, K. W. Qian, and K. L. Wu, A cascaded coupled resonator decoupling network for mitigating interference between two radios in adjacent frequency bands, IEEE Trans. Microw. Theory Tech., vol. 62, no. 11, pp. 2680-2688, November 2014" uses a parallel and separate arrangement scheme. Two antenna elements working in different frequency bands are placed close to each other to cover dual frequency bands. However, the parallel separation arrangement scheme still requires a lot of space. For example, in order to reduce the mutual coupling between different-frequency elements, the decoupling network designed in this literature increases the structural complexity and is not easy to expand to massive MIMO antenna arrays. Literature "R. Wu and Q. Chu, A compact, dual-polarized multiband array for 2G/3G/4G base stations, IEEE Trans. Antennas Propag., vol. 67, no. 4, pp. 2298-2304, April 2019" uses an embedded solution. The high-frequency dipole is placed inside the low-frequency bowl-shaped dipole to cover the dual frequency bands in a shared aperture. However, the antenna element spacing is too large, about $0.95\lambda_c$ ($\lambda_c$ is the free-space wavelength at the center operating frequency). In the literature "H. Sun, C. Ding, H. Zhu, B. Jones, and Y. J. Guo, Suppression of cross-band scattering in multiband antenna arrays, IEEE Trans. Antennas Propag., vol. 67, no. 4, pp. 2379-2389, April 2019", an interleaving scheme is used, low-frequency dipole antennas are interlaced in the middle of high-frequency dipoles, and a radio frequency (RF) choke is placed on the radiator of the low-frequency element, in order to suppress the induced high-frequency scattering current, thereby reducing the radiation pattern distortion.

Compared with the above-mentioned three schemes, the radiator multiplexing and stacking scheme may integrate multiple original parts of different frequency bands into the same area of a radiator, so a more compact size can be obtained. Literature "J. F. Zhang, Y. J. Cheng, Y. R. Ding, and C. X. Bai, A dual-band shared-aperture antenna with large frequency ratio, high aperture reuse efficiency, and high channel isolation, IEEE Trans. Antennas Propag., vol. 67, no. 2, pp. 853-860, February 2019" uses a radiator multiplexing scheme. At 60 GHz, the entire structure of the 12×12 substrate integrated waveguide (SIW) slot array is reused as a 3.5-GHz patch radiator to form a shared-aperture dual-band array. This antenna effectively utilizes a radiation aperture and has high cross-band isolation, but this method is not suitable for arrays with a relatively small ratio of high and low operating frequencies. Literature "Y. Zhu, Y. Chen, and S. Yang, Decoupling and low-profile design of dual-band dual-polarized base station antennas using frequency-selective surface, IEEE Trans. Antennas Propag., vol. 67, no. 8" uses a stacking scheme. In its designed dual-band array, a frequency selective surface (FSS) is inserted between the low-frequency and high-frequency antenna elements to reduce mutual coupling between different frequencies. However, due to the integration of multiple components, the entire antenna array has a large volume.

SUMMARY OF THE INVENTION

The objective of the present invention is to overcome the above-mentioned shortcomings and deficiencies of the prior art. Under the application background of 5G base stations, a shared-aperture dual-band dual-polarized antenna array is provided, which is more compact than the existing solutions, which maintains high cross-band isolation and stable radiation pattern in dual bands.

Another objective of the present invention is to provide a communication device.

The objectives of the present invention may be achieved by adopting the following technical solutions:

A shared-aperture dual-band dual-polarized antenna array, comprising a first dielectric substrate, a second dielectric substrate, a third dielectric substrate, a fourth dielectric substrate, and a fifth dielectric substrate sequentially arranged from top to bottom, the first dielectric substrate, the second dielectric substrate, and the third dielectric substrate constitute a dielectric substrate group, the dielectric substrate group is provided with a low-frequency antenna element and four high-frequency antenna elements, the low-frequency antenna element is loaded with a filtering structure, and both the low-frequency antenna element and the high-frequency antenna element are fed by coaxial lines, the fourth dielectric substrate and the fifth dielectric substrate form a dual-function metasurface, when the metasurface is used as an artificial magnetic conductor reflector, radiation of the low-frequency antenna element is enhanced in a low profile, and when the metasurface is used as a frequency selective surface, electromagnetic scattering of the low-frequency antenna element in the high-frequency operating band is suppressed.

Further, the low-frequency antenna element comprises a low-frequency full-wavelength radiation slot and two low-frequency stepped impedance feeding lines, the low-frequency full-wavelength radiation slot is arranged on a first ground plane on an upper surface of the third dielectric substrate, the low-frequency full-wavelength radiation slot and the first ground plane are bent downward, and the low-frequency full-wavelength radiation slot is provided with four pairs of open-circuited coupling microstrip lines and the four pairs of open-circuited coupling microstrip lines are respectively connected to the first ground plane, the two low-frequency stepped impedance feeding lines are crossed on a lower surface of the third dielectric substrate, and the low-frequency full-wavelength radiation gap is fed through the two low-frequency stepped impedance feeding lines to achieve low frequency band ±45° dual-polarized radiation; each low-frequency stepped impedance feeding line is provided with a quarter-wavelength open-circuited microstrip stub, an open-circuited coupling microstrip line and a quarter-wavelength open-circuited microstrip stub constitute a filtering structure.

Further, one end of each low-frequency stepped impedance feeding line is connected to the first ground plane through a metal via, the other end is connected to a first feeding pad on the first ground plane through a metal via, the first feeding pad is connected to a pin of a first coaxial line inner conductor of the low-frequency antenna element, and a first coaxial line outer conductor is connected to a first ground pad on a lower surface of the third dielectric substrate and a second ground plane on a lower surface of the fifth dielectric substrate, the first ground pad is connected to the first ground plane through a metal via.

Further, the low-frequency full-wavelength radiation slot is a cross-shaped radiation slot, and four sides of the cross-shaped radiation slot are bending downwards on the four sides of the first ground plane, a vertical part of the cross-shaped radiation gap forms an arrow shape, wherein two pairs of the open-circuited coupling microstrip lines are symmetrically arranged at left and right horizontal parts of the cross-shaped radiation slot, and the other two pairs of the coupling microstrip lines are symmetrically arranged at the front and rear horizontal parts of the cross-shaped radiation slot, and each low-frequency stepped impedance feeding line is meandered.

Further, each high-frequency antenna element comprises a stacked patch, an excitation patch and a pair of high-frequency feeding line, four stacked patches, four excitation patches, and four pairs of high-frequency feeding lines of four high-frequency antenna elements are in a one-to-one position correspondence relationship, each stacked patch is arranged on an upper surface of the first dielectric substrate, each excitation patch is arranged on an upper surface of the second dielectric substrate, and each pair of high-frequency feeding lines is arranged on a lower surface of the second dielectric substrate, corresponding excitation patches are fed through each pair of high-frequency feeding lines to achieve high-frequency band ±45° dual-polarized radiation.

Further, four symmetrical full-wavelength loop microstrip lines are placed around each stacked patch.

Further, each excitation patch is provided with four mutually symmetrical square slots.

Further, characterized in that, each pair of high-frequency feeding lines comprises two H-shaped microstrip lines that cross each other, a corresponding excitation patch is fed through the two H-shaped microstrip lines to achieve high-frequency ±45° dual-polarized radiation; each H-shaped microstrip line is connected to a second feeding pad on an upper surface of the second dielectric substrate through a metal via, the second feeding pad is connected to a second coaxial inner conductor pin of the high-frequency antenna element; a second coaxial line outer conductor is connected to a second ground pad on a lower surface of the third dielectric substrate and a second ground plane on a lower surface of the fifth dielectric substrate, the second ground pad is connected to a first ground plane on an upper surface of the third dielectric substrate through a metal via.

Further, an upper surface of the fourth dielectric substrate is provided with N×N periodic patch units, each periodic patch unit is provided with four first square loop slots that are symmetrical to each other, a second ground plane on a lower surface of the fifth dielectric substrate is provided with a second square loop slot at a corresponding position of the first square loop slot, where N≥2, and is a natural number.

Another objective of the present invention may be achieved by adopting the following technical solutions:

A communication device comprises the above-mentioned shared-aperture dual-band dual-polarized antenna array.

Compared with the prior art, the present invention has the following beneficial effects:

1. The present invention sets a low-frequency antenna element working at 0.69-0.96 GHz and four high-frequency antenna elements working at 3.4-3.7 GHz, and by loading the filtering structure on the low-frequency antenna element, the out-of-band radiation of the low-frequency antenna element in the high frequency band is reduced, and the cross-band coupling is reduced. In addition, a dual-function metasurface is used to suppress the mutual coupling and scattering of different frequencies. The dual-function metasurface may be used as an artificial magnetic conductor reflector in a low profile to enhance the radiation of the low-frequency slot antenna. It has band-pass transmission performance as a frequency selective surface in the high-frequency range, and suppresses the electromagnetic scattering of the low-frequency antenna element in the high-frequency range, thereby reducing the negative influence of the low-frequency antenna element on the radiation pattern of the high-frequency antenna element, and reducing the distortion of the radiation pattern of the high-frequency antenna element.

2. In the low-frequency antenna element of the present invention, four pairs of open-circuited coupling microstrip lines are arranged in the low-frequency full-wavelength radiation slot, and each low-frequency stepped impedance feeding line is provided with a quarter-wavelength open-circuited microstrip stub. Open-circuited coupling microstrip line and quarter-wavelength open-circuited microstrip stub constitute a filtering structure to achieve the filtering function of the low-frequency antenna element. It can effectively suppress its out-of-band radiation in the high-frequency band of 3.2-3.8 GHz, thereby reducing the cross-band coupling.

3. The low-frequency full-wavelength radiation slot of the low-frequency antenna element of the present invention and the first ground plane on the upper surface of the third dielectric substrate are bent downwards. As the first ground plane is transformed from a two-dimensional (2D) plane to a three-dimensional (3D) bending shape, the overall size of the antenna array is reduced to achieve miniaturization, and the overall size is reduced by 57.4%.

DESCRIPTION OF THE FIGURES

In order to explain the embodiments of the present invention or the technical solutions in the prior art more clearly, the following will briefly introduce the figures that need to be used in the description of the embodiments or the prior art. Obviously, the figures in the following description are only some embodiments of the present invention. For those of ordinary skill in the art, other figures can be obtained based on these drawings without inventive work.

wherein 1—first dielectric substrate, 11—first stacked patch, 12—second stacked patch, 13—third stacked patch, 14—fourth stacked patch, 15—full-wavelength loop microstrip line, 2—second dielectric substrate, 21—first excitation patch, 22—second excitation patch, 23—third excitation patch, 24—fourth excitation patch, 251—first port, 252—second port, 253—third port, 254—fourth port, 255—fifth port, 256—sixth port, 257—seventh port, 258—eighth port, 261—first high-frequency feeding line, 262—second high-frequency feeding line, 263—third high-frequency feeding line, 264—fourth high-frequency feeding line, 265—fifth high-frequency feeding line, 266—sixth high-frequency feeding line, 267—seventh high-frequency feeding line, 268—eighth high-frequency feeding line, 3—third dielectric substrate, 311, 312, 313 and 314—open-circuited coupling microstrip lines, 32—first feeding pad, 321—ninth port, 322—tenth port, 33—low-frequency full-wavelength radiation slot, 34—first ground plane, 35—quarter-wavelength open-circuited microstrip stub, 36—first ground pad, 37—second ground pad, 4—fourth dielectric substrate, 5—fifth dielectric substrate, 6—second ground plane, 61—second square loop slot, 7—periodical patch unit cell, 71—first square loop slot.

DESCRIPTION

The technical solutions in the embodiments of the present invention will be clearly and completely described below in conjunction with the accompanying figures in the embodiments of the present invention. Obviously, the described embodiments are only a part of the embodiments of the present invention, rather than all the embodiments. Based on the embodiments of the present invention, all other embodiments obtained by those of ordinary skill in the art without inventive work shall fall within the protection scope of the present invention.

For ease of description, the following and the accompanying figures will take a shared-aperture dual-band dual-polarization antenna array based on a filtering slot antenna and a dual-function metasurface as an example to illustrate a shared-aperture dual-band dual-polarization antenna array provided by the embodiments of the present invention. It should be understood that the embodiments of the present invention are not limited to a shared-aperture dual-band dual-polarized antenna array based on a filtering slot antenna and a dual-function metasurface, but should include all shared-aperture dual-band dual-polarized antenna arrays with the characteristics of the present invention.

Figure 1:
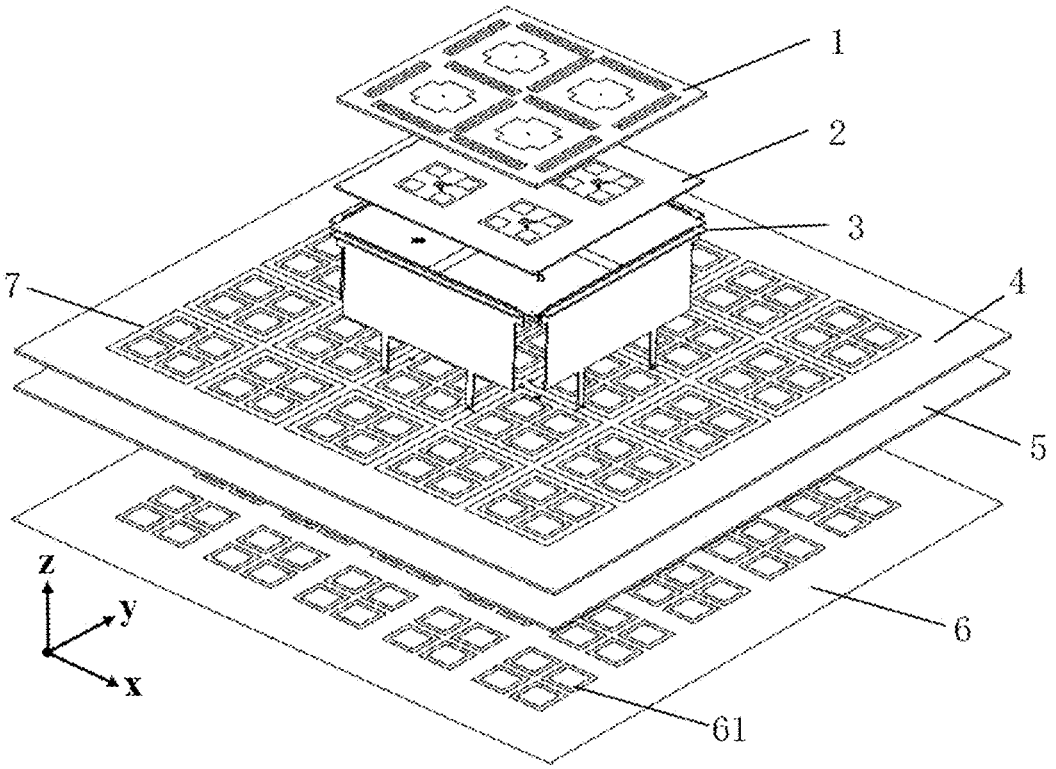
FIG. 1 is an exploded view of a shared-aperture dual-band dual-polarized antenna array provided by an embodiment of the present invention.
Figure 2:
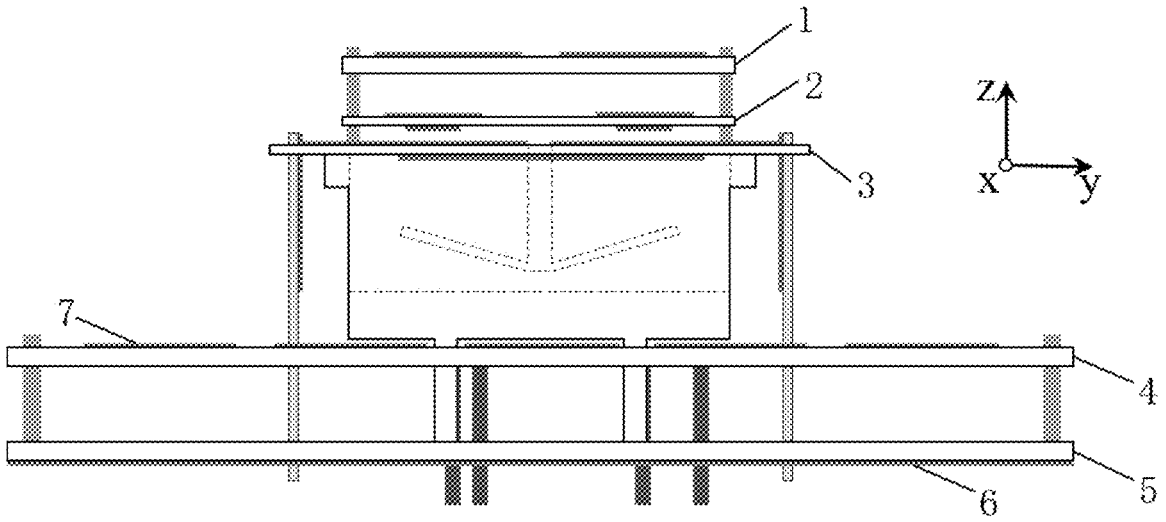
FIG. 2 is a side view of a shared-aperture dual-band dual-polarized antenna array provided by an embodiment of the present invention.
Figure 3:
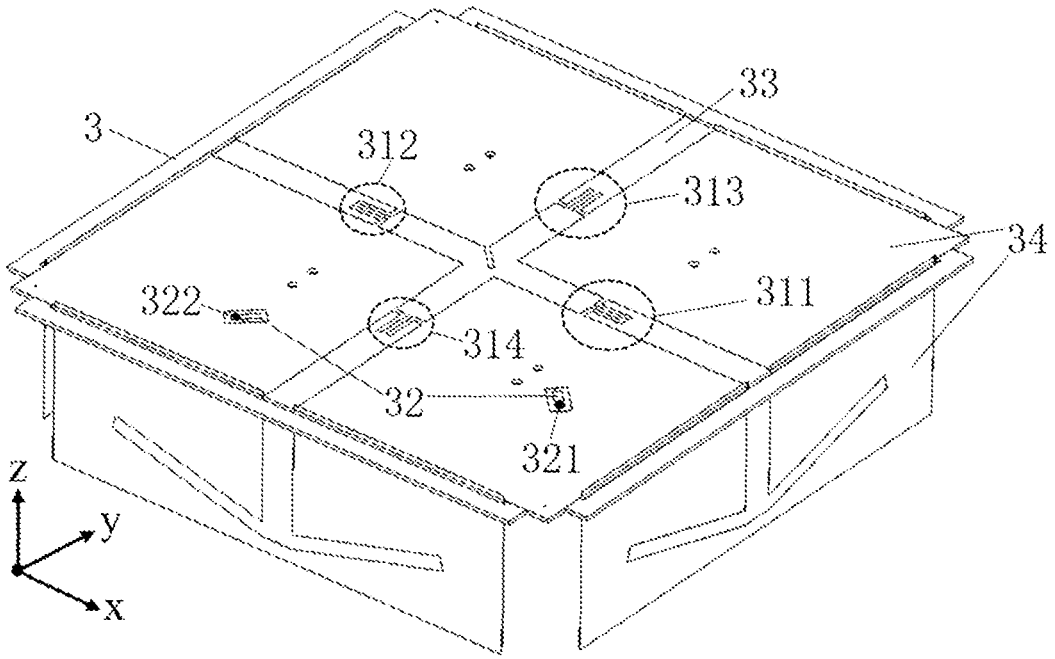
FIG. 3 is a three-dimensional structural view of a low-frequency antenna element provided by an embodiment of the present invention (the vertical substrate is transparent).
Figure 4:
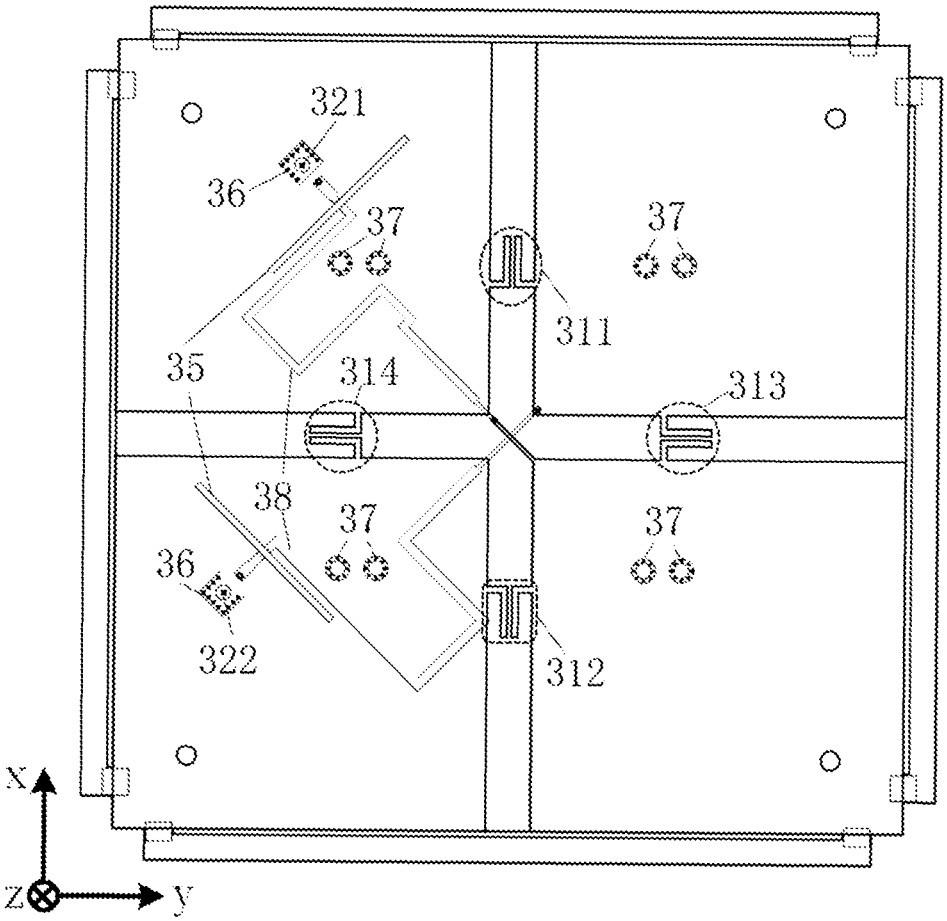
FIG. 4 is an illustrative diagram of the geometry of a feeding network of a low-frequency antenna element on the lower surface of the third-layer dielectric substrate according to an embodiment of the present invention.

As shown in FIGS. 1 and 2, the shared-aperture dual-band dual-polarized antenna array of this embodiment comprises five layers of dielectric substrates, and the five layers of dielectric substrates are a first dielectric substrate 1, a second dielectric substrate 2, a third dielectric substrate 3, a fourth dielectric substrate 4 and a fifth dielectric substrate 5. The first dielectric substrate 1, the second dielectric substrate 2, the third dielectric substrate 3, the fourth dielectric substrate 4 and the fifth dielectric substrate 5 are arranged in order from top to bottom. The first dielectric substrate 1, the second dielectric substrate 2 and the third dielectric substrate 3 constitute a dielectric substrate group. The dielectric substrate group is provided with a low-frequency antenna element and four high-frequency antenna elements. The low-frequency antenna element works at 0.69-0.96 GHz. Each high-frequency antenna element works at 3.4-3.7 GHz, and the low-frequency antenna element is loaded with a filtering structure, which may reduce the out-of-band radiation of the low-frequency antenna element in the high-frequency band and reduce the coupling between different-frequency elements. Both the low-frequency antenna element and the high-frequency antenna element are fed by coaxial lines (also called coaxial cables). The coaxial line of the low-frequency antenna element is the first coaxial line, and both the first coaxial line and the second coaxial line pass through the third dielectric substrates 3, the fourth dielectric substrate 4 and the fifth dielectric substrate 5. The coaxial line of the high-frequency antenna element is the second coaxial line. The fourth dielectric substrate 4 and the fifth dielectric substrate 5 constitute a dual-function metasurface.

In this embodiment, the first dielectric substrate 1, the second dielectric substrate 2, and the third dielectric substrate 3 use Rogers 4003 dielectric substrates with a thickness of 1.524 mm or 0.813 mm. The fourth dielectric substrate 4 and the fifth dielectric substrate 5 use Rogers 4350 dielectric substrate, and the thickness may be 1.524 mm. The distance between the first layer of dielectric substrate 1 and the second layer of dielectric substrate 2 is 5 mm. There is an air gap with a thickness of 1 mm between the second layer of dielectric substrate 2 and the third layer of dielectric substrate 3. There is an air gap with a thickness of 12 mm between the fourth layer of dielectric substrate 4 and the fifth layer of dielectric substrate 5, and the distance between adjacent high-frequency antenna elements is 20 mm (about $0.24\lambda_c$).

The following describes the low-frequency antenna element, the high-frequency antenna element, and the dual-function metasurface in detail with reference to FIGS. 1 to 8.

As shown in FIGS. 1 to 4, the first ground plane 34 on the upper surface (top surface) of the third dielectric substrate 3 is etched with a low-frequency full-wavelength radiation slot 33, and a first feeding pad 32 is provided on the first ground plane 34. The full-wavelength radiation slot 33 and the first ground plane 34 are bent downwards. Since the first ground plane 34 is transformed from a two-dimensional plane to a three-dimensional bent shape, the overall size of the antenna array is reduced to achieve miniaturization. The lower surface (bottom surface) of the third dielectric substrate 3 is printed with two low-frequency stepped impedance feeding lines 38, and the lower surface of the third dielectric substrate 3 is provided with a first ground pad 36 and a second ground pad 37. The first ground pad 36 is a low-frequency ground pad, and the second ground pad 37 is a high-frequency ground pad. Two low-frequency stepped impedance feeding lines 38 cross each other, and each low-frequency stepped impedance feeding line 38 is a bent feeding line so the size may be reduced. The low-frequency full-wavelength radiation slot 33 and two low-frequency stepped impedance feeding lines 38 constitute the main part of the low-frequency antenna element. The low-frequency full-wavelength radiation slot 33 is fed through the two low-frequency stepped impedance feeding lines 38. In order to achieve ±45° dual-polarized radiation in the low frequency band, the low-frequency full-wavelength radiation slot 33 is used as the radiator, which may achieve a wide-band effect.

Four pairs of open-circuited coupling microstrip lines 311, 312, 313 and 314 are arranged in the low-frequency full-wavelength radiation slot 33, and the four pairs of open-circuited coupling microstrip lines 311, 312, 313 and 314 are respectively connected to the first ground plane 34 to suppress the radiation of the low-frequency full-wavelength radiation slot 33 at about 3.5 GHz. Each low-frequency stepped impedance feeding line 38 is provided with a quarter-wavelength open-circuited microstrip stub 35, that is, there are two quarter-wavelength open-circuited microstrip stubs 35, forming a pair of quarter-wavelength open-circuited microstrip stubs 35. The quarter-wavelength open-circuited micro strip stub 35 extends from low-frequency stepped impedance feeding line 38 to suppress high-frequency resonance. The open-circuited coupling microstrip lines 311, 312, 313 and 314 and quarter-wavelength open-circuited microstrip stub 35 constitute a filtering structure to achieve a filtering function, effectively suppressing its out-of-band radiation in the high-frequency band of 3.2-3.8 GHz, thereby reducing cross-band coupling.

Further, the low-frequency full-wavelength radiation slot 33 is a cross-shaped radiation slot, and the four sides of the cross-shaped radiation slot and the four sides of the first ground plane 34 are bent downwards, so that the cross-shaped radiation slot is divided into horizontal parts (a total of four left, right, front, and rear horizontal parts) and vertical parts (a total of four left, right, front and rear vertical parts). The vertical parts of the cross-shaped radiation slot form an arrow shape to further reduce the size, wherein two pairs of open-circuited coupling microstrip lines 311, 312, 313 and 314 are symmetrically arranged on the front and rear horizontal parts of the cross-shaped radiation slot. The other two pairs of coupling microstrip lines 311, 312, 313 and 314 are symmetrically arranged on the left and right horizontal parts of the cross-shaped radiation slot.

Further, one end of each low-frequency stepped impedance feeding line 38 is connected to the first ground plane 34 through a metalized via, and the other end is connected to the first feeding pad 32 on the first ground plane 34 through a metalized via. The first feeding pad 32 is connected to the pin of the inner conductor of the first coaxial line. The outer conductor of the first coaxial line is connected to the first ground pad 36 on the lower surface of the third dielectric substrate 3 and the second ground plane 6 on the lower surface of the fifth dielectric substrate 5 by welding. The first ground pad 36 is connected to the first ground plane 34 through a metalized via.

As shown in FIGS. 1 to 7, the upper surface (top surface) of the first dielectric substrate 1 is printed with four stacked patches. The four stacked patches are the first stacked patch 11, the second stacked patch 12, the third stacked patch 13 and the fourth stacked patch 14. The upper surface (top surface) of the second dielectric substrate 2 is printed with four excitation patches (also called driven patches). The four excitation patches are the first excitation patch 21, the second excitation patch 22, the third excitation patch 23, and the fourth excitation patch 24. The lower surface (bottom surface) of the second dielectric substrate 2 is printed with four pairs of high-frequency feeding lines. Each pair of high-frequency feeding line comprises two high-frequency feeding lines, that is, a total of eight high-frequency feeding lines. The eight high-frequency feeding lines are the first high-frequency feeding line 261, the second high-frequency feeding line 262, the third high-frequency feeding line 263, the fourth high-frequency feeding line 264, the fifth high-frequency feeding line 265, the sixth high-frequency feeding line 266, the seventh high-frequency feeding line 267, and the eighth high-frequency feeding line 268. The positions of the first stacked patch 11, the first excitation patch 21, the first high-frequency feeding line 261 and the second high-frequency feeding line 262 correspond to each other. The first excitation patch 21 is fed through the first high-frequency feeding line 261 and the second high-frequency feeding line 262 to achieve dual-polarized radiation at a high frequency band of ±45°. The positions of the second stacked patch 12, the second excitation patch 22, the third high-frequency feeding line 263 and the fourth high-frequency feeding line 264 correspond to each other. The second excitation patch 22 is fed through the third high-frequency feeding line 263 and the fourth high-frequency feeding line 264, so as to realize the high-frequency band ±45° dual-polarized radiation. The positions of the third stacked patch 13, the third excitation patch 23, the fifth high-frequency feeding line 265, and the sixth high-frequency feeding line 266 correspond to each other. The third excitation patch 23 is fed through the fifth high-frequency feeding line 265 and the sixth high-frequency feeding line 266, so as to realize the high-frequency band ±45° dual-polarized radiation. The positions of the fourth stacked patch 14, the fourth excitation patch 24, the seventh high-frequency feeding line 267, and the eighth high-frequency feeding line 268 correspond to each other. The fourth excitation patch 24 is fed through the seventh high-frequency feeding line 267 and the eighth high-frequency feeding line 268, so as to realize the high-frequency band ±45° dual-polarized radiation. Four stacked patches, four excitation patches and four pairs of high-frequency feeding lines constitute four high-frequency antenna elements. The four high-frequency antenna elements and the low-frequency antenna element share the first ground plane 34. In addition, the four high-frequency antenna elements are symmetrical with respect to the low-frequency full-wavelength radiation slot 33 of the low-frequency antenna element.

Further, the eight high-frequency feeding lines are all H-shaped microstrip lines. The first high-frequency feeding line 261 and the second high-frequency feeding line 262 cross each other. The third high-frequency feeding line 263 and the fourth high-frequency feeding line 264 cross each other. The fifth high-frequency feeding line 265 and the sixth high-frequency feeding line 266 cross each other. The seventh high-frequency feeding line 267 and the eighth high-frequency feeding line 268 cross each other.

Figure 5:
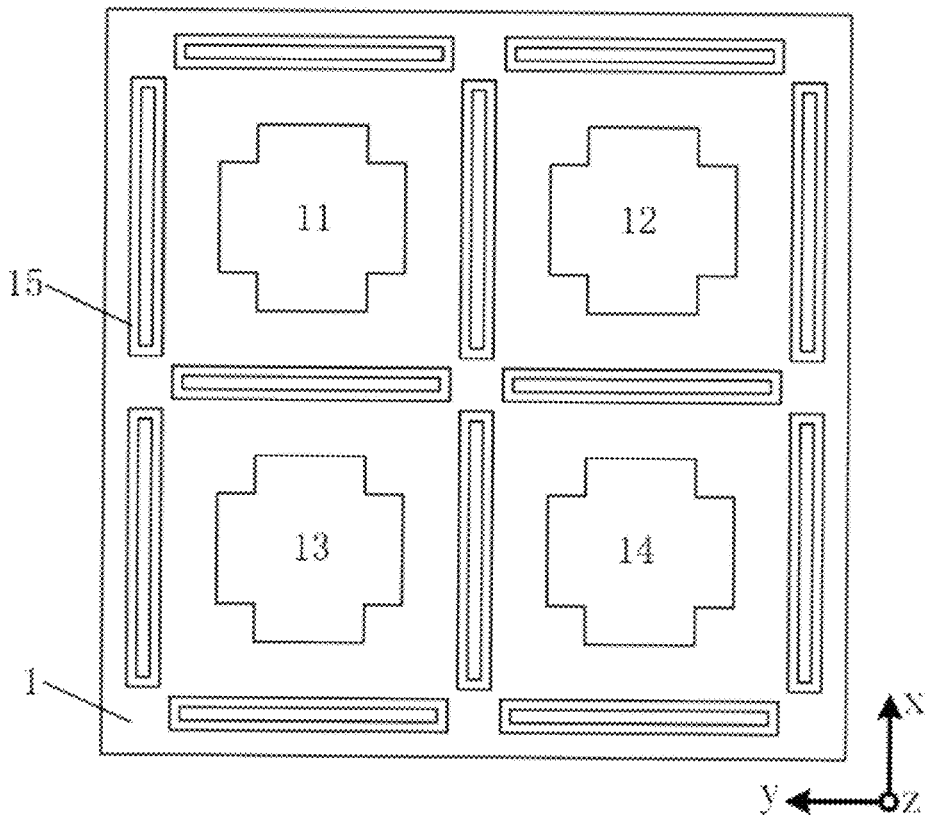
FIG. 5 is an illustrative diagram of the stacked patch of the high-frequency antenna element on the upper surface of the first layer of the dielectric substrate provided by the embodiment of the present invention.
Figure 6:
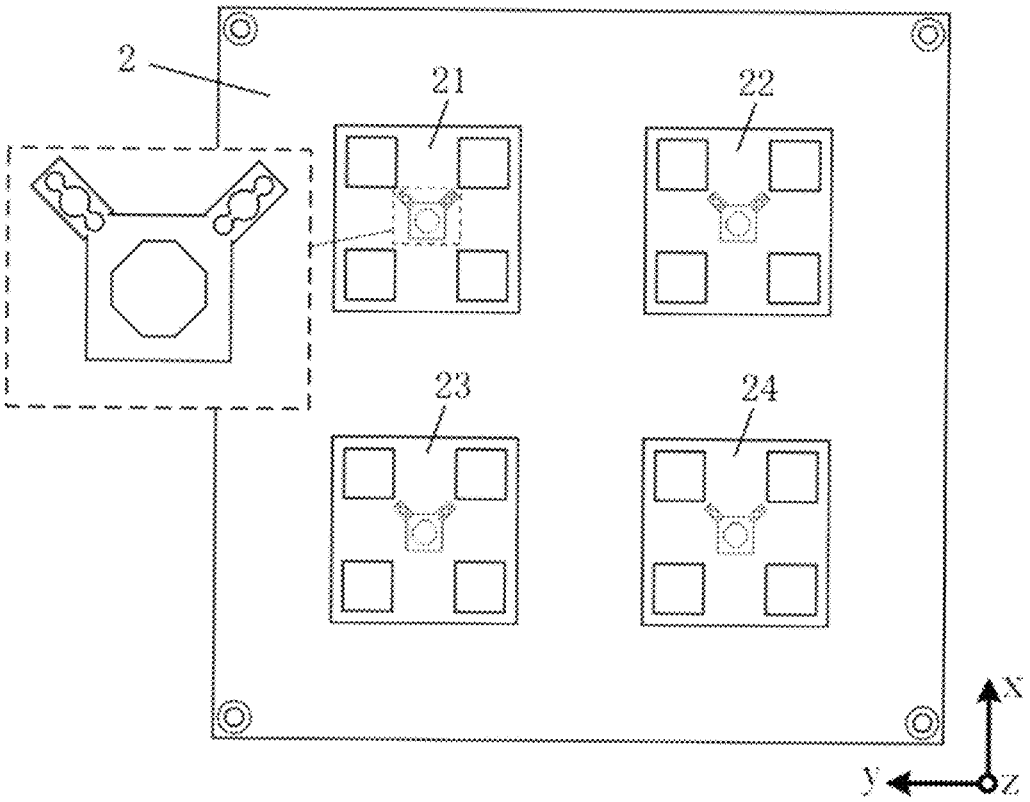
FIG. 6 is an illustrative diagram of the excitation patch of the high-frequency antenna element on the upper surface of the second-layer dielectric substrate according to an embodiment of the present invention.
Figure 7:
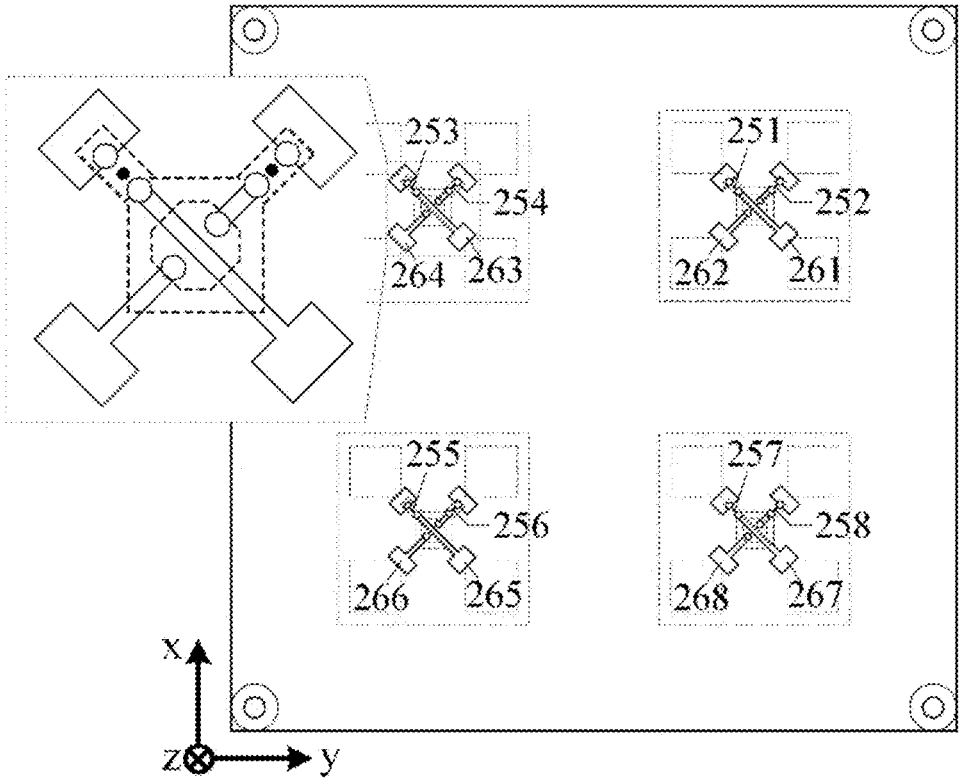
FIG. 7 is an illustrative diagram of a high-frequency feeding line of a high-frequency antenna element on the lower surface of a second-layer dielectric substrate according to an embodiment of the present invention.
Figure 8:
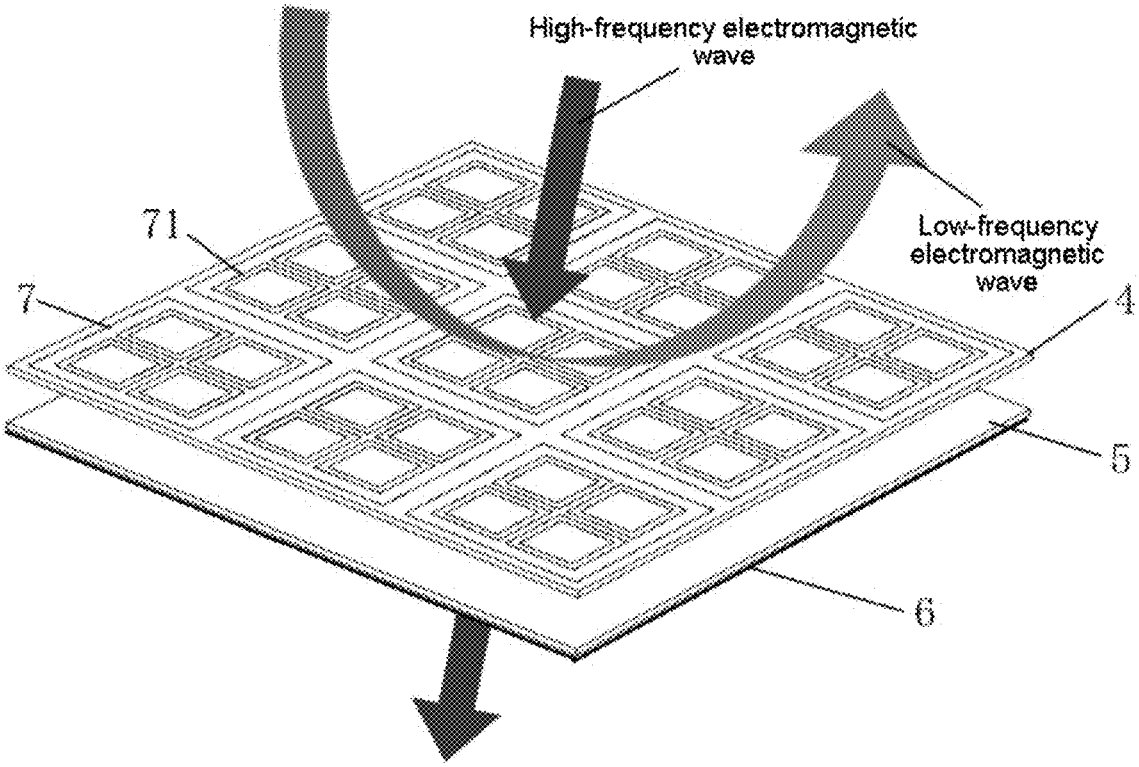
FIG. 8 is an illustrative diagram of a dual-function metasurface provided by an embodiment of the present invention.

Further, taking the positive x-axis direction of FIG. 5 as the rear side, the negative x-axis direction as the front side, the positive y-axis direction as the right side, and the negative y-axis direction as the left side, a full-wavelength loop microstrip line 15 is respectively placed between the left and back sides of the first stacked patch 11, the right and back sides of the second stacked patch 12, the left and front sides of the third stacked patch 13, the right and front sides of the fourth stacked patch 14, between the first stacked patch 11 and the second stacked patch 12, between the first stacked patch 11 and the third stacked patch 13, between the second stacked patch 12 and the fourth stacked patch 14, between the third stacked patch 13 and the fourth stacked patches 14, that is there are twelve full-wavelength loop microstrip lines 15 in total. Each stacked patch is surrounded by four symmetric full-wavelength loop microstrip lines 15 to reduce the in-band coupling of the high-frequency antenna elements. Each excitation patch is etched with four mutually symmetrical square slots to make each high-frequency antenna element compact.

Further, each high-frequency feeding line is connected to a second feeding pad on the upper surface of the second dielectric substrate 2 through a metal via. The second feeding pad is connected to the inner conductor pin of the second coaxial line. The second coaxial outer conductor is connected to the second ground pad 37 on the lower surface of the third dielectric substrate 3 and the second ground plane 6 on the lower surface of the fifth dielectric substrate 4 by welding. The second ground pad 37 is connected to the first ground plane 34 on the upper surface of the third dielectric substrate 3 through a metalized via.

In addition, the first port 251, the third port 253, the fifth port 255 and the seventh port 257 excite −45° polarized radiation in the high-frequency band. The second port 252, the fourth port 254, the sixth port 256 and the eighth port 258 excites 45° polarized radiation in the high-frequency band. The ninth port 321 and the tenth port 322 excite −45° and 45° polarized radiation in the low-frequency band respectively.

As shown in FIGS. 1 to 8, in order to reduce the scattering of the high-frequency antenna element, this embodiment designs a dual-function metasurface formed by a fourth layer of dielectric substrate 4 and a fifth layer of dielectric substrate 5. Two functions of the dual-function metasurface: 1) As an Artificial Magnetic Conductor (AMC) reflector, reflecting low-frequency electromagnetic waves when the low-frequency antenna element achieves a low profile, that is, enhancing the radiation of the low-frequency antenna element in a low profile; 2) As a band-pass frequency selective surface (FSS for short), it realizes band-pass transmission of electromagnetic waves in high-frequency bands, suppresses electromagnetic scattering of low-frequency antenna elements in high-frequency bands, thereby reducing the negative impact of radiation pattern of low-frequency antenna elements on high-frequency antenna elements.

Further, the upper surface (top surface) of the fourth dielectric substrate 4 is provided with 5×5 periodic patch units 7. Each periodic patch unit is etched with four first square loop slots 71 that are symmetrical to each other. The four first square loop slots 71 are periodically arranged on the upper surface of the fourth dielectric substrate 4. The second ground plane 6 on the lower surface (bottom surface) of the fifth dielectric substrate 5 is a metasurface ground. The second ground plane 6 etches the second square loop slot 61 on the corresponding position of the first square loop slot. The position and size of the second square loop slot 61 and the first square loop slot 71 are exactly the same, and they are also arranged periodically.

Figure 9:
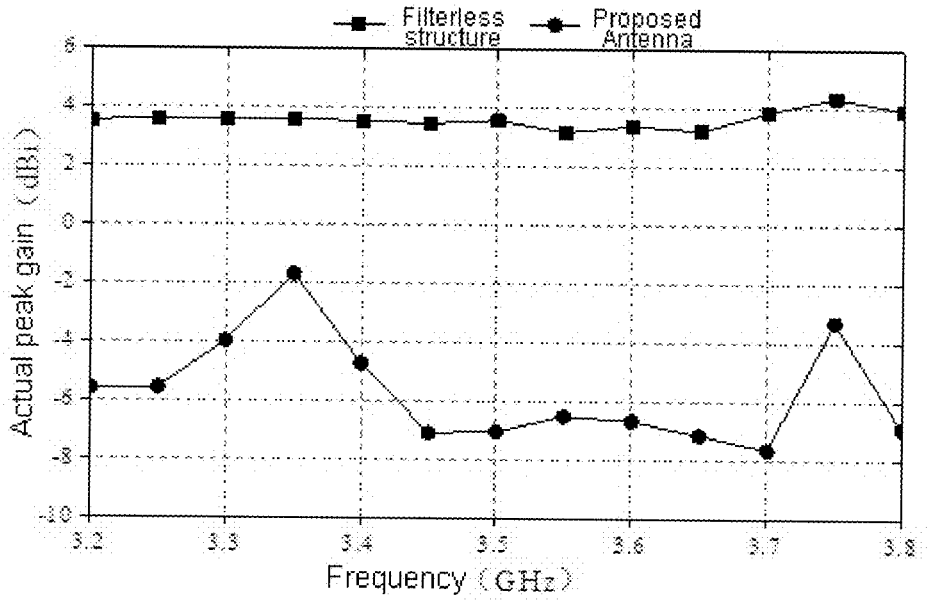
FIG. 9 is a comparison diagram of peak gain curves of a shared-aperture dual-band dual-polarized antenna array provided by an embodiment of the present invention and an antenna with a common filterless structure in a high-frequency band.
Figure 10:
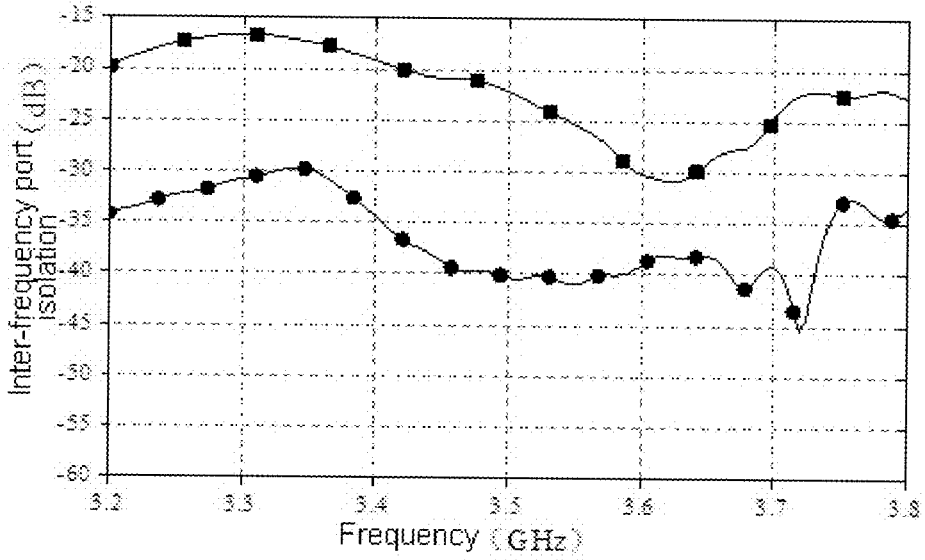
FIG. 10 is a comparison diagram of the isolation curve of different-frequency ports between a shared-aperture dual-band dual-polarized antenna array provided by an embodiment of the present invention and a common filterless antenna structure in a high-frequency band.

Shown in FIGS. 9 to 10 are the comparison diagram of the peak gain curve and the comparison diagram of the isolation curve of the cross-band port respectively of the shared-aperture dual-band dual-polarized antenna array provided by this embodiment and the common filterless structure antenna in the high frequency band, wherein the filterless structure antenna is completed by removing two quarter-wavelength open-circuited microstrip stubs 35 and four pairs of open-circuited coupling microstrip lines 311, 312, 313 and 314 from the low-frequency antenna element provided in the embodiment. Clearly, it can be seen that the peak gain achieved by the antenna array proposed in this embodiment in the 3.4-3.55 GHz frequency band is greatly reduced; while the coupling degree of the cross-band port is less than −35 dB, which is much lower than the filterless structure. Therefore, the cross-band port isolation is greatly improved through out-of-band suppression performance.

Figure 11:
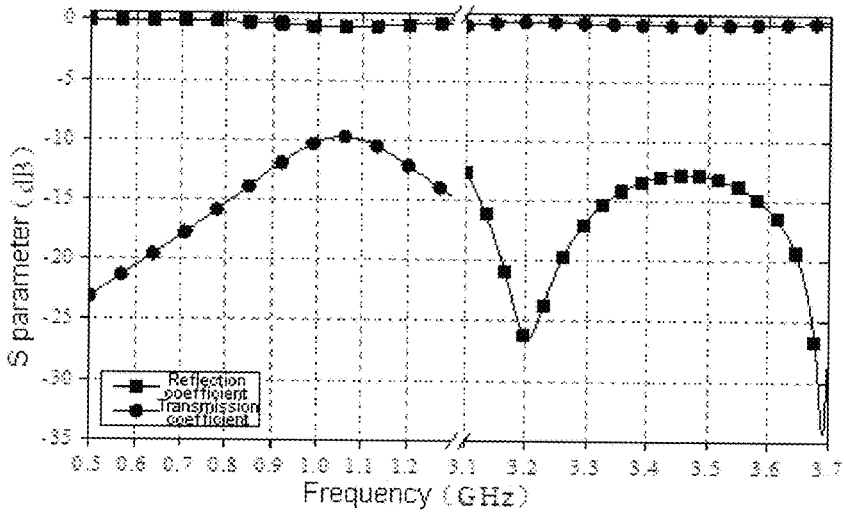
FIG. 11 is a graph of low-frequency and high-frequency reflection and transmission coefficients of a dual-function metasurface provided by an embodiment of the present invention.
Figure 12:
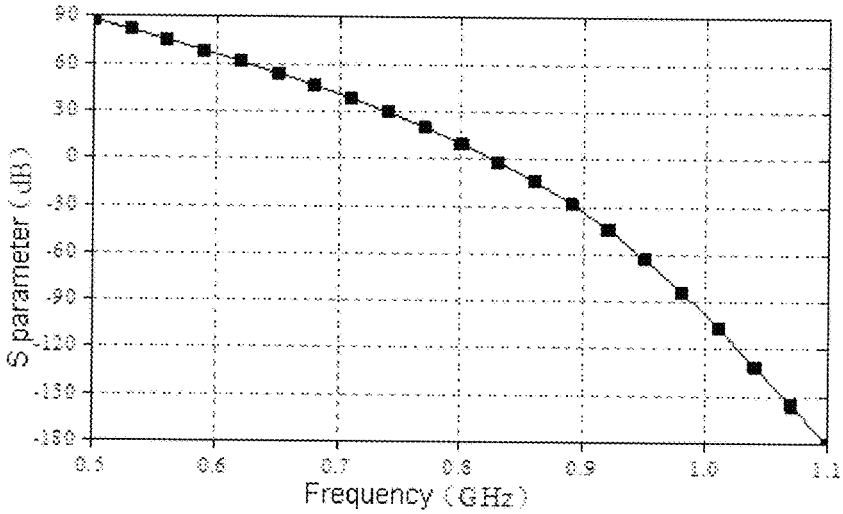
FIG. 12 is a low-frequency reflection phase curve diagram of a dual-function metasurface provided by an embodiment of the present invention.

Shown in FIGS. 11 to 12 are the low-frequency and high-frequency reflection and transmission coefficient curves respectively of the dual-function metasurface provided by this embodiment, and the reflection phase curve of the low-frequency band. It can be seen from FIG. 11 that the amplitude of the reflection coefficient in the 0.69-0.96 GHz band is higher than −0.5 dB. The reflection phase in FIG. 12 ranges from 43.7° to −69.6°, which means that the metasurface can be used as an artificial magnetic conductor reflector and used to make the antenna realize a unidirectional radiation pattern in a low profile. The transmission coefficient amplitude of the 3.4-3.7 GHz frequency band in FIG. 12 is about −0.3 dB, which indicates that the metasurface can function as a frequency selective surface to pass high-frequency radiated electromagnetic waves.

Figure 13:
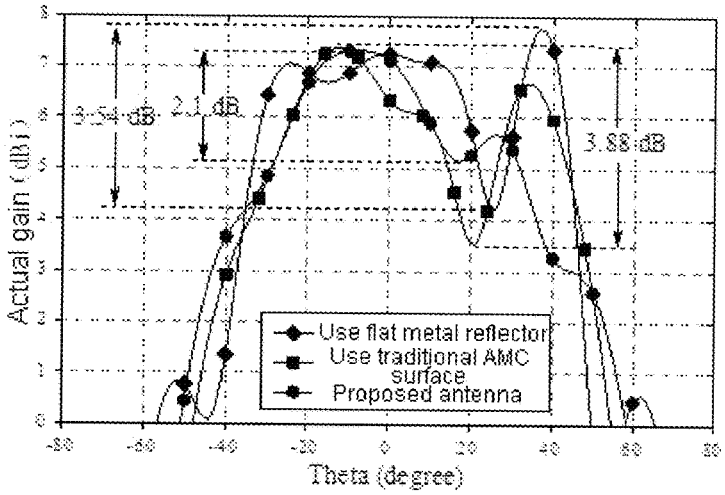
FIG. 13 is a two-dimensional gain comparison diagram of a shared-aperture dual-band dual-polarized antenna array provided by an embodiment of the present invention and an antenna using a flat metal reflector and a traditional AMC surface at 3.7 GHz.
Figure 14:
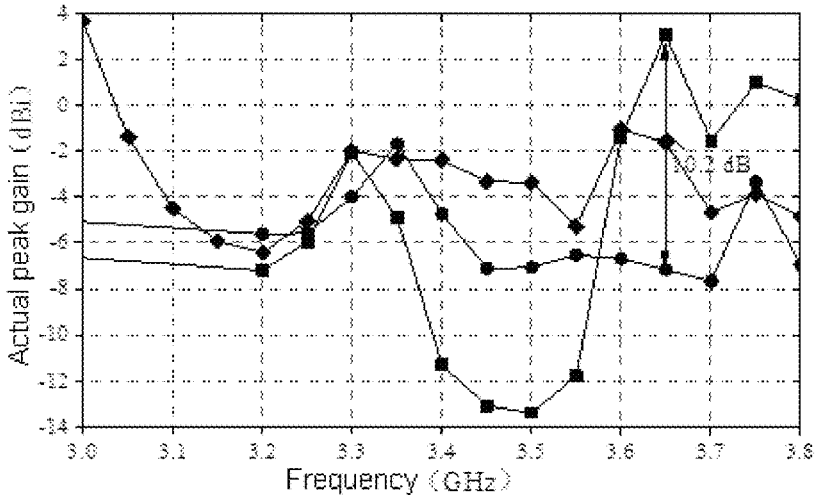
FIG. 14 is a comparison diagram of peak gains between a shared-aperture dual-band dual-polarized antenna array provided by an embodiment of the present invention and an antenna using a flat metal reflector and a traditional AMC surface.
Figure 15:
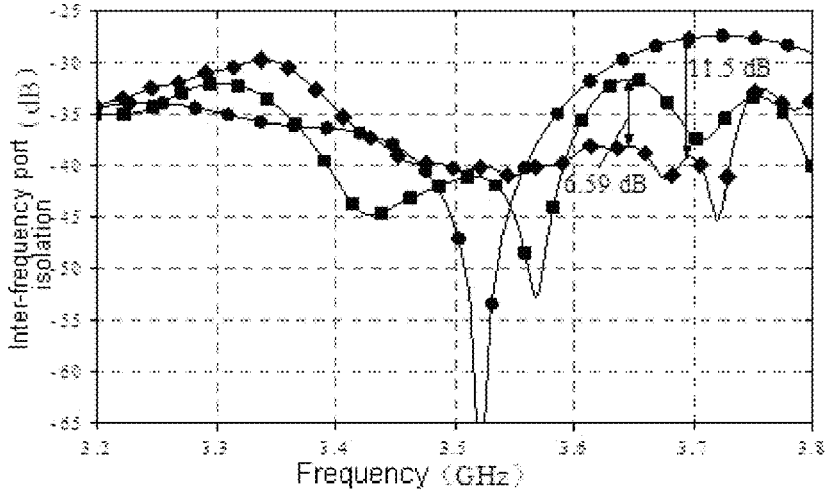
FIG. 15 is a comparison diagram of isolation curves of different frequency ports between a shared-aperture dual-band dual-polarized antenna array provided by an embodiment of the present invention and an antenna using a flat metal reflector and a traditional AMC surface.

Shown in FIGS. 13 to 15 are comparison diagrams of two-dimensional gain comparison diagrams, peak gain comparison diagrams, and cross-band port isolation curves respectively of the shared-aperture dual-band dual-polarized antenna array provided in this embodiment and the antenna using a flat metal reflector and a traditional AMC surface at 3.7 GHz. It can be seen from FIG. 13 that the radiation pattern of the high-frequency antenna using the flat metal reflector and the traditional AMC antenna is severely distorted at 3.7 GHz. In the two-dimensional plane of phi=45°, the antenna using the flat metal reflector and traditional AMC antenna have radiation null points in theta=25° and 20° directions, respectively. It can be seen from FIG. 14 and FIG. 15 that compared with the antenna using the flat metal reflector, the peak gain of the antenna array proposed in this embodiment at 3.65 GHz is reduced by about 5.5 dB, and the degree of cross-band coupling is reduced by less than 6.59 dB. Compared with the traditional AMC antenna, the peak gain of the antenna array proposed in this embodiment at 3.65 GHz is reduced by about 10.2 dB, and the coupling degree of the cross-band port is reduced by about 11 dB.

Figure 16:
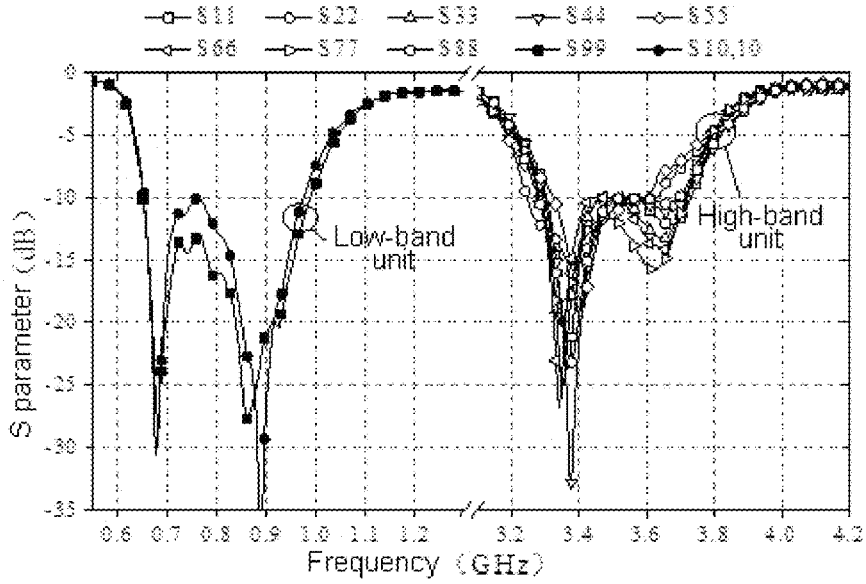
FIG. 16 is a measurement result diagram of the reflection coefficients of all ports of the shared-aperture dual-band dual-polarized antenna array provided by an embodiment of the present invention.

Shown in FIG. 16 is the measurement result of the reflection coefficients of all ports of the shared-aperture dual-band dual-polarized antenna array provided for the embodiment. It can be seen that when the low-frequency antenna element works in the 0.653-0.971 GHz frequency band, the reflection coefficient is lower than −10 dB; when the high-frequency antenna element works in the 3.32-3.62 GHz frequency band, the reflection coefficient is lower than −10 dB.

Figure 17:
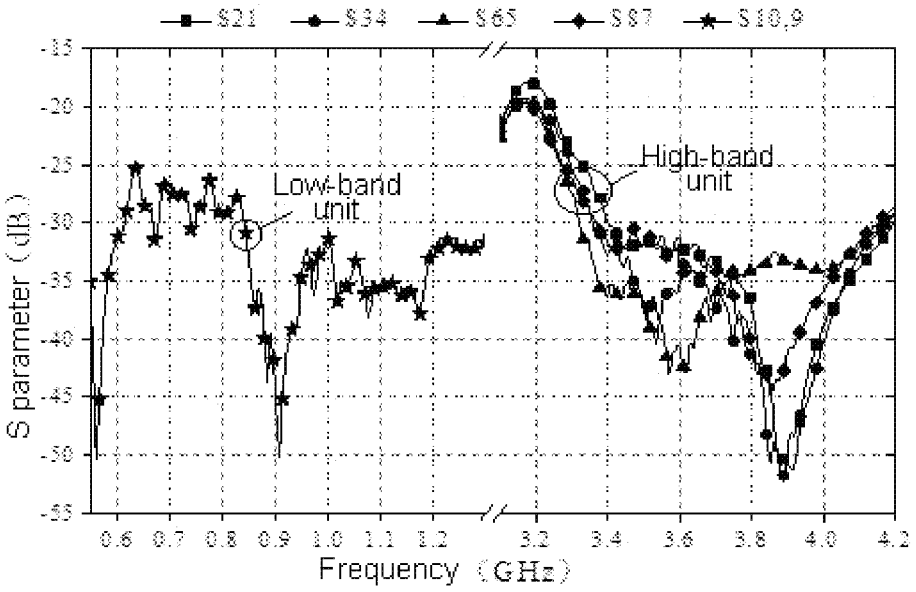
FIG. 17 is a measurement result diagram of the polarization coupling degree of each unit of the shared-aperture dual-band dual-polarized antenna array provided by an embodiment of the present invention.

Shown in FIG. 17 is the measurement result of the polarization coupling degree of each element of the shared-aperture dual-band dual-polarized antenna array provided in this embodiment. It can be seen that the polarization isolation of the low-frequency antenna element in the 0.69-0.96 GHz frequency band is higher than 25 dB; the polarization isolation of the high-frequency antenna element in the 3.4-3.7 GHz frequency band is higher than 30 dB.

Figure 18:
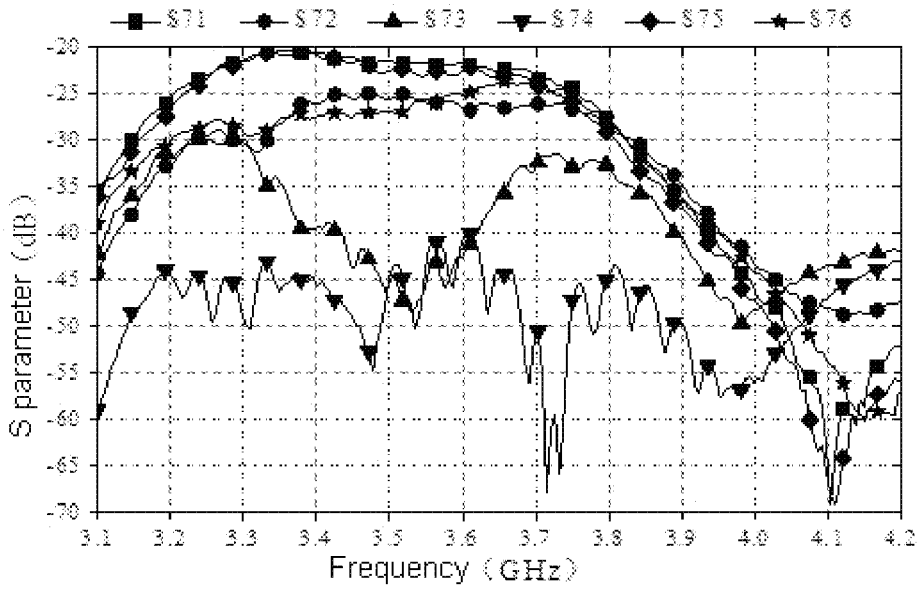
FIG. 18 is a diagram of the measurement result of the in-band coupling degree of the high-frequency antenna element of the antenna array provided by the embodiment of the present invention.

Shown in FIG. 18 is the measurement result of the in-band coupling degree of the high-frequency antenna element of the antenna array provided by this embodiment. It can be seen that in the 3.4-3.7 GHz frequency band, the in-band isolation between the high-frequency antenna elements is higher than 20 dB.

Figure 19:
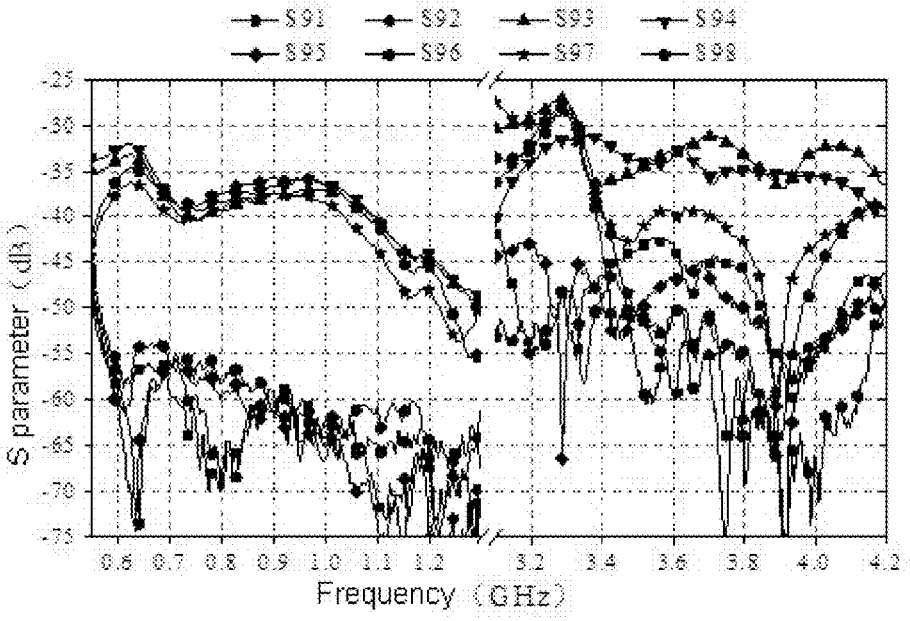
FIG. 19 is a diagram of the measurement result of the cross-band coupling degree of the antenna array provided by an embodiment of the present invention.

Shown in FIG. 19 is the measurement result diagram of the cross-band coupling degree of the antenna array provided by this embodiment. It can be seen that the cross-band port isolation between the low-frequency antenna element and the high-frequency antenna element is higher than 34 dB in 0.69-0.96 GHz and higher than 32 dB in 3.4-3.7 GHz.

Figure 20:
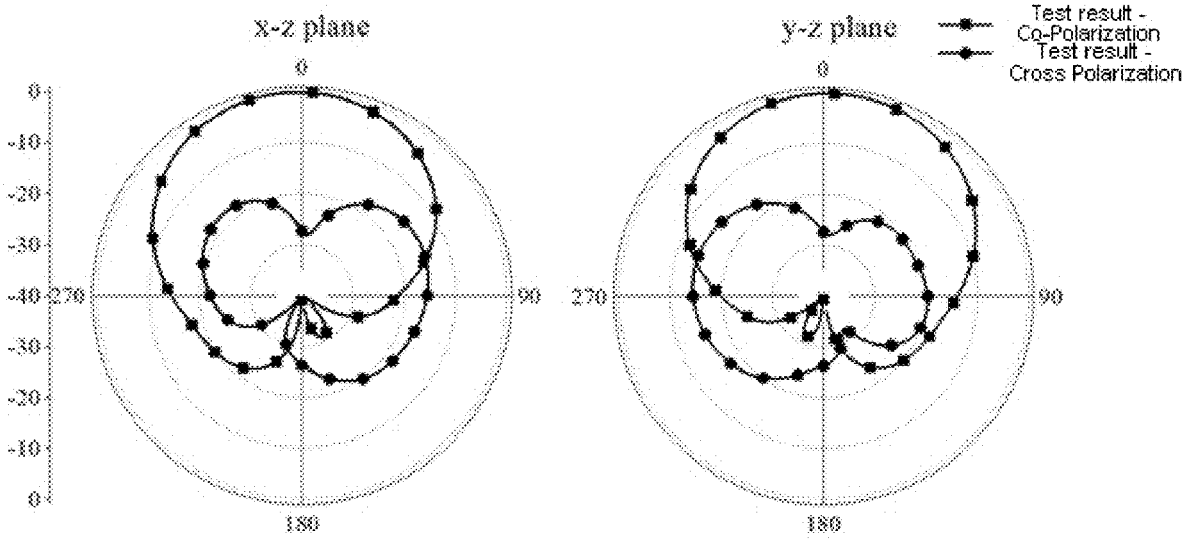
FIG. 20 is a two-dimensional radiation pattern of a low-frequency antenna element provided by an embodiment of the present invention at 0.69 GHz through a ninth excitation port.
Figure 21:
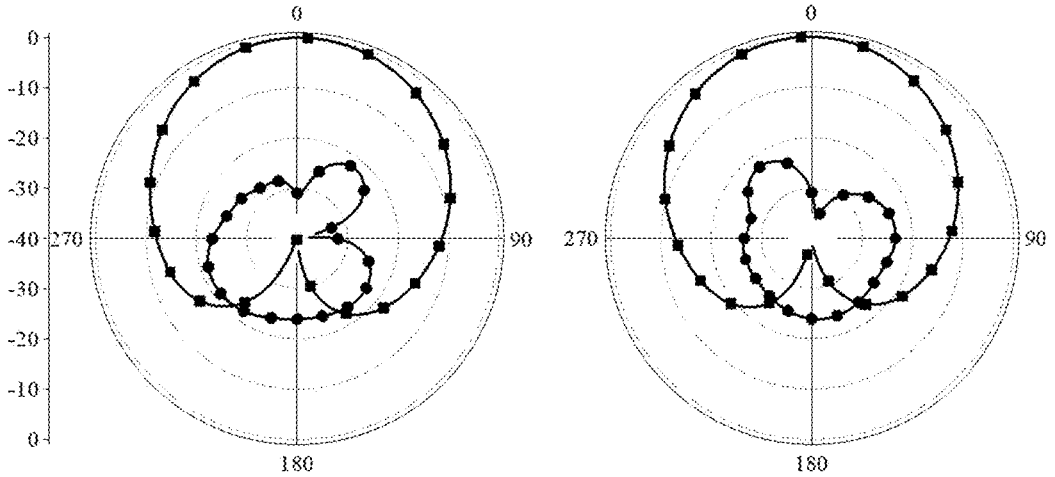
FIG. 21 is a two-dimensional radiation pattern of a low-frequency antenna element provided by an embodiment of the present invention at 0.96 GHz through a ninth excitation port.

Shown in FIG. 20 to FIG. 21 are the two-dimensional radiation pattern at 0.69 GHz and the two-dimensional radiation pattern at 0.96 GHz of the low-frequency antenna element provided in this embodiment through the ninth excitation port respectively. The low-frequency radiation patterns of the ninth excitation port 321 and the tenth excitation port 322 are similar. Therefore, by selecting only the low-frequency radiation pattern of the ninth excitation port 321, it can be seen that the low-frequency antenna element has a stable broadside radiation pattern and will not produce pattern distortion in the working frequency band, while the 3-dB beam range for the ninth excitation port 321 is 73° to 79°, and the cross-polarization level is less than −15 dB.

Figure 22:
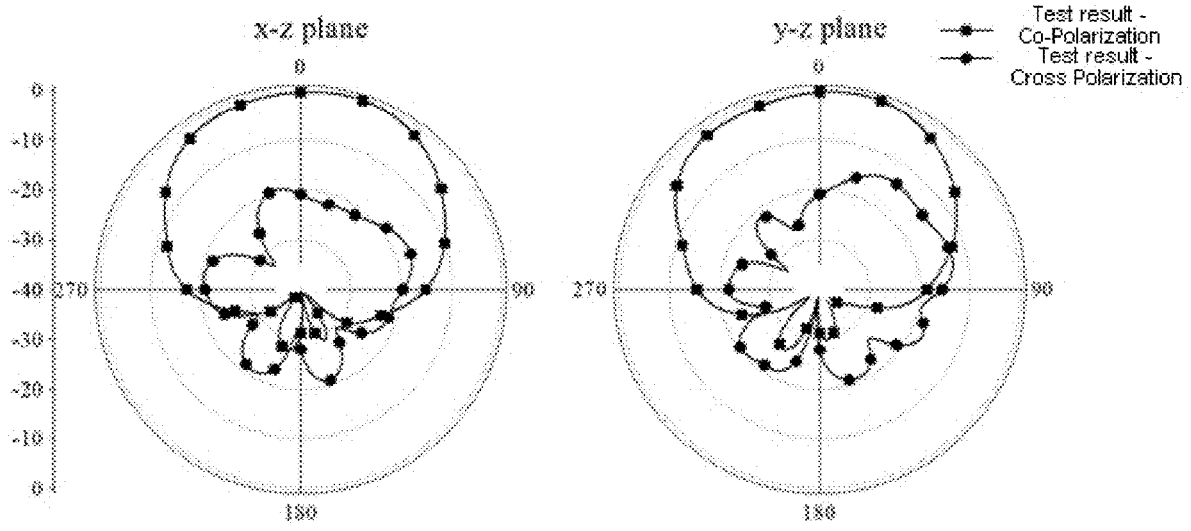
FIG. 22 is a two-dimensional radiation pattern of a high-frequency antenna element provided by an embodiment of the present invention at 3.4 GHz through a first excitation port.
Figure 23:
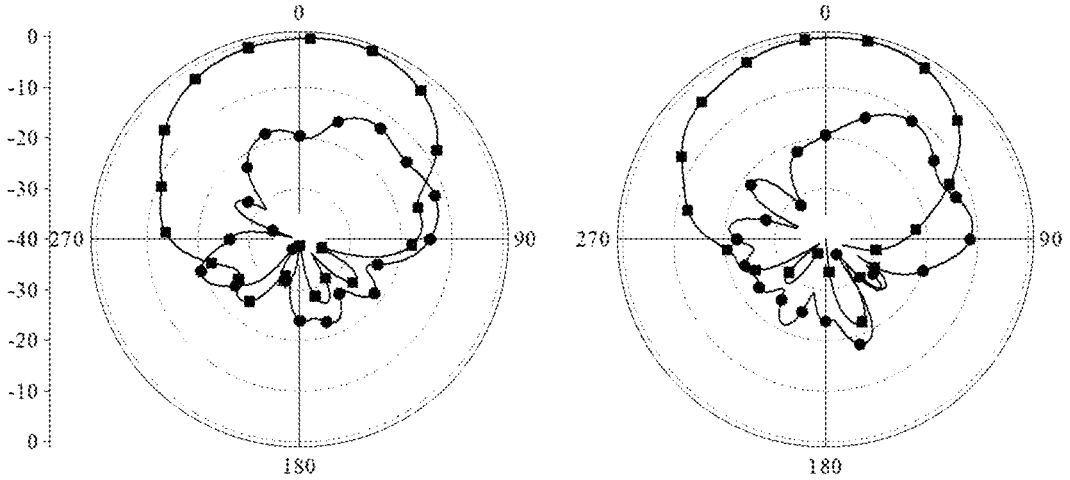
FIG. 23 is a two-dimensional radiation pattern of a high-frequency antenna element provided by an embodiment of the present invention at 3.7 GHz through a first excitation port.

Shown in FIG. 22 to FIG. 23 are the two-dimensional radiation pattern at 3.4 GHz and the two-dimensional radiation pattern at 3.7 GHz of the high-frequency antenna element provided by this embodiment through the first excitation port, respectively. The high-frequency radiation patterns of the first port 251 to the eighth port 258 are also similar. Therefore, only the first port 251 is selected to display the high-frequency radiation pattern. It can be seen that the high-frequency antenna element has a stable broadside radiation pattern. There is no pattern distortion in the working frequency band. The 3-dB beam range of the first port 251 is 76° to 84°, and the high-frequency cross-polarization level is less than −15 dB.

Figure 24:
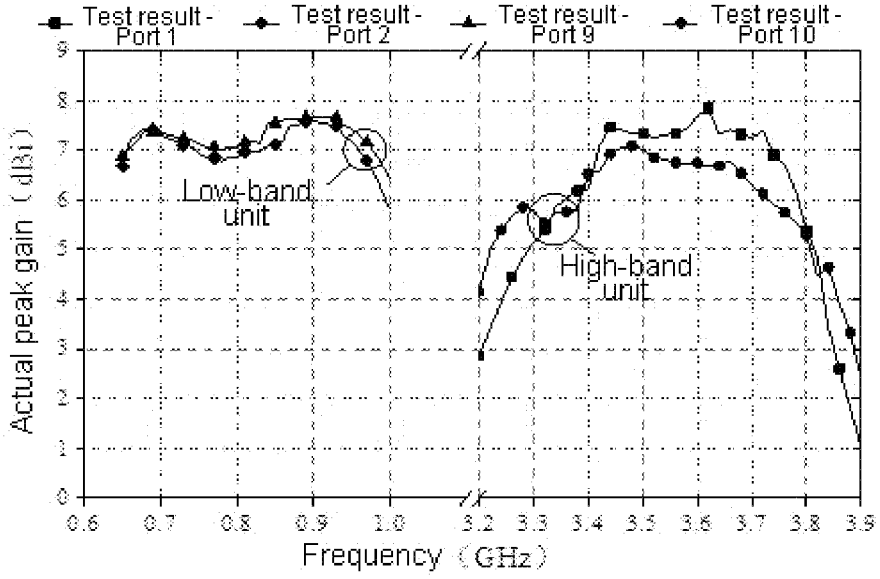
FIG. 24 is a graph of the measurement results of the peak gain obtained through the first excitation port, the second excitation port, the ninth excitation port, and the tenth excitation port of the shared-aperture dual-band dual-polarized antenna array provided by an embodiment of the present invention.

Shown in FIG. 24 is a graph of the measurement result of the peak gain obtained through the first excitation port, the second excitation port, the ninth excitation port, and the tenth excitation port of the shared-aperture dual-band dual-polarized antenna array provided by an embodiment of the present invention. The gains of the first excitation port 251 and the second excitation port 252 are selected to represent the −45° and 45° polarization radiation of the high-frequency antenna element. The measured peak gain of the low-frequency antenna element is 7.0 to 7.7 dBi in the range of 0.69-0.96 GHz. The high-frequency antenna element is 6.3 to 7.9 dBi in the range of 3.4-3.7 GHz, and the peak gain corresponding to each port fluctuates little in the respective operating frequency band.

This embodiment also provides a communication device, which is a transmitting and receiving device of a wireless communication system, and comprises the above-mentioned shared-aperture dual-band dual-polarized antenna array.

In summary, the present invention sets a low-frequency antenna element working at 0.69-0.96 GHz and four high-frequency antenna elements working at 3.4-3.7 GHz, and by loading the filtering structure on the low-frequency antenna element, the out-of-band radiation of the low-frequency antenna element in the high frequency band is reduced, and the cross-band coupling is reduced; in addition, the dual-function metasurface is used to suppress mutual coupling and scattering at different frequencies. The dual-function metasurface may be used as an artificial magnetic conductor reflector in a low profile to enhance the radiation of the low-frequency slot antenna. It has band-pass transmission performance as a frequency selection surface in the high-frequency range, and suppress the electromagnetic scattering of the low-frequency antenna element in the high-frequency band, thereby reducing the negative influence of the low-frequency antenna element on the radiation pattern of the high-frequency antenna element, and reducing the distortion of the radiation pattern of the high-frequency antenna element.

The above are only the preferred embodiments of the present invention patent, but the protection scope of the present invention patent is not limited to this. Any person familiar with the technical field in the scope disclosed by the present invention patent can make equivalent substitutions or changes according to the technical solution and the inventive concept of the present invention patent, which shall fall within the protection scope of the present invention patent.

We claim:

1. A shared-aperture dual-band dual-polarized antenna array, characterized in that, comprising a first dielectric substrate, a second dielectric substrate, a third dielectric substrate, a fourth dielectric substrate, and a fifth dielectric substrate sequentially arranged from top to bottom, the first dielectric substrate, the second dielectric substrate, and the third dielectric substrate constitute a dielectric substrate group, the dielectric substrate group is provided with a low-frequency antenna element and four high-frequency antenna elements, the low-frequency antenna element is loaded with a filtering structure, and both the low-frequency antenna element and the high-frequency antenna element are fed by coaxial lines, the fourth dielectric substrate and the fifth dielectric substrate form a dual-function metasurface, when the surface is used as an artificial magnetic conductor reflector, a radiation of the low-frequency antenna element is enhanced in a low profile, and when the surface is used as a frequency selection surface, an electromagnetic scattering of the low-frequency antenna element in a high-frequency band is suppressed.

2. The shared-aperture dual-band dual-polarized antenna array according to claim 1, characterized in that, the low-frequency antenna element comprises a low-frequency full-wavelength radiation slot and two low-frequency stepped impedance feeding lines, the low-frequency full-wavelength radiation slot is arranged on a first ground plane on an upper surface of the third dielectric substrate, the low-frequency full-wavelength radiation slot and the first ground plane are bent downwards, and the low-frequency full-wavelength radiation slot is provided with four pairs of open-circuited coupling microstrip lines and the four pairs of open-circuited coupling microstrip lines are respectively connected to the first ground plane, the two low-frequency stepped impedance feeding lines are crossed on a lower surface of the third dielectric substrate, and the low-frequency full-wavelength radiation slot is fed through the two low-frequency stepped impedance feeding lines to achieve low-frequency band ±45° dual-polarized radiation; each low-frequency stepped impedance feeding line is provided with a quarter-wavelength open-circuited microstrip stub, an open-circuit coupling microstrip line and a quarter-wavelength open-circuited microstrip stub constitute the filtering structure.

3. The shared-aperture dual-band dual-polarized antenna array according to claim 2, characterized in that, one end of each low-frequency stepped impedance feeding line is connected to the first ground plane through a metal via, the other end is connected to a first feeding pad on the first ground plane through a metal via, the first feeding pad is connected to a pin of a first coaxial line inner conductor of the low-frequency antenna element, and a first coaxial line outer conductor is connected to a first ground pad on a lower surface of the third dielectric substrate and a second ground plane on a lower surface of the fifth dielectric substrate, the first ground pad is connected to the first ground plane through a metal via.

4. The shared-aperture dual-band dual-polarized antenna array according to claim 2, characterized in that, the low-frequency full-wavelength radiation slot is a cross-shaped radiation slot, and four sides of the cross-shaped radiation slot are bent downwards on the four sides of the first ground plane, a vertical part of the cross-shaped radiation slot forms an arrow shape, wherein two pairs of the open-circuited coupling microstrip lines are symmetrically arranged at left and right horizontal parts of the cross-shaped radiation slot, and the other two pairs of the coupling microstrip lines are symmetrically arranged at the front and rear horizontal parts of the cross-shaped radiation slot, and each low-frequency stepped impedance feeding line is a bent feeding line.

5. The shared-aperture dual-band dual-polarized antenna array according to claim 1, characterized in that, each high-frequency antenna element comprises a stacked patch, an excitation patch and a pair of high-frequency feeding lines, four stacked patches, four excitation patches, and four pairs of high-frequency feeding lines of four high-frequency antenna elements are in a one-to-one position correspondence relationship, each stacked patch is arranged on an upper surface of the first dielectric substrate, each excitation patch is arranged on an upper surface of the second dielectric substrate, and each pair of high-frequency feeding lines is arranged on a lower surface of the second dielectric substrate, corresponding excitation patches are fed through each pair of high-frequency feeding lines to achieve high-frequency band ±45° dual-polarized radiation.

6. The shared-aperture dual-band dual-polarized antenna array according to claim 5, characterized in that, four symmetrical full-wavelength loop microstrip lines are placed around each stacked patch.

7. The shared-aperture dual-band dual-polarized antenna array according to claim 5, characterized in that, each excitation patch is provided with four mutually symmetrical square slots.

8. The shared-aperture dual-band dual-polarized antenna array according to claim 5, characterized in that, each pair of high-frequency feeding lines comprises two H-shaped microstrip lines that cross each other, a corresponding excitation patch is fed through the two H-shaped microstrip lines to achieve high-frequency ±45° dual-polarization radiation; each H-shaped microstrip line is connected to a second feeding pad on an upper surface of the second dielectric substrate through a metal via, the second feeding pad is connected to a second coaxial line inner conductor pin of the high-frequency antenna element; a second coaxial line outer conductor is connected to a second ground pad on a lower surface of the third dielectric substrate and a second ground plane on a lower surface of the fifth dielectric substrate, the second ground pad is connected to a first ground plane on an upper surface of the third dielectric substrate through a metal via.

9. The shared-aperture dual-band dual-polarized antenna array according to claim 1, characterized in that, an upper surface of the fourth dielectric substrate is provided with N×N periodic patch units, each periodic patch unit is provided with four first square loop slots that are symmetrical to each other, a second ground plane on a lower surface of the fifth dielectric substrate is provided with second square loop slots at a corresponding position of the first square loop slots, where N≥2, and is a natural number.

10. A communication device, characterized in that, comprising the shared-aperture dual-band dual-polarized antenna array according to claim 1.

* * * * *